US010339865B2

(12) United States Patent
Chen et al.

(10) Patent No.: US 10,339,865 B2
(45) Date of Patent: Jul. 2, 2019

(54) PIXEL DRIVER CIRCUIT HAVING TWO PIXEL DRIVERS AND DISPLAY DEVICE THEREOF

(71) Applicants: BOE TECHNOLOGY GROUP CO., LTD., Beijing (CN); HEFEI XINSHENG OPTOELECTRONICS TECHNOLOGY CO., LTD., Anhui (CN)

(72) Inventors: Mo Chen, Beijing (CN); Jian Zhao, Beijing (CN); Miao Zhang, Beijing (CN); Jing Sun, Beijing (CN); Songmei Sun, Beijing (CN)

(73) Assignees: BOE TECHNOLOGY GROUP CO. LTD. (CN); HEFEI XINSHENG OPTOELECTRONICS TECHNOLOGY CO., LTD. (CN)

( * ) Notice: Subject to any disclaimer, the term of this patent is extended or adjusted under 35 U.S.C. 154(b) by 36 days.

(21) Appl. No.: 15/310,227

(22) PCT Filed: Mar. 1, 2016

(86) PCT No.: PCT/CN2016/075111
§ 371 (c)(1),
(2) Date: Nov. 10, 2016

(87) PCT Pub. No.: WO2017/054406
PCT Pub. Date: Apr. 6, 2017

(65) Prior Publication Data

US 2017/0263184 A1 Sep. 14, 2017

(30) Foreign Application Priority Data

Sep. 28, 2015 (CN) ..... 2015 2 0759201 U

(51) Int. Cl.
*G09G 3/3258* (2016.01)
*G09G 3/3266* (2016.01)
(Continued)

(52) U.S. Cl.
CPC ..... *G09G 3/3258* (2013.01); *G09G 3/3233* (2013.01); *G09G 3/3266* (2013.01);
(Continued)

(58) Field of Classification Search
CPC ..... G09G 3/3258
(Continued)

(56) References Cited

U.S. PATENT DOCUMENTS 8,242,981 B2 8/2012 Kim
2005/0174311 A1* 8/2005 Huh ..... G09G 3/3233 345/87
(Continued)

FOREIGN PATENT DOCUMENTS

CN 102044212 A 5/2011
CN 202855271 U 4/2013
(Continued)

OTHER PUBLICATIONS

International Search Report and Written Opinion for Application No. PCT/CN2016/075111, dated Mar. 1, 2016, 12 Pages.

*Primary Examiner* — Long D Pham
(74) *Attorney, Agent, or Firm* — Brooks Kushman P.C.

(57) ABSTRACT

The present disclosure provides a pixel driver circuit, a pixel circuit, a display panel and a display device. The pixel driver circuit includes two pixel driving units having an identical structure. Each pixel driving unit includes a driving transistor and a driving control module. A gate electrode of the driving transistor is connected to the driving control module, a first electrode thereof receives a first power voltage, and a second electrode thereof is connected to the driving control
(Continued)

module and a light-emitting element. The driving control module is connected to a data line, a gate line, and the gate electrode and the second electrode of the driving transistor, and controls a potential at the gate electrode of the driving transistor in accordance with a data voltage applied to the data line under control of a gate driving signal from the gate line, so as to turn on/off the driving transistor.

17 Claims, 2 Drawing Sheets

(51) Int. Cl.
*G09G 3/3291* (2016.01)
*G09G 3/3233* (2016.01)

(52) U.S. Cl.
CPC ..... *G09G 3/3291* (2013.01); *G09G 2300/043* (2013.01); *G09G 2300/0809* (2013.01); *G09G 2300/0852* (2013.01); *G09G 2310/0262* (2013.01); *G09G 2320/043* (2013.01); *G09G 2320/0646* (2013.01)

(58) Field of Classification Search
USPC ..... 345/84
See application file for complete search history.

(56) References Cited

U.S. PATENT DOCUMENTS

2010/0141645 A1 6/2010 Choi et al.
2016/0189604 A1* 6/2016 Hu ..... G09G 3/3225 345/215

FOREIGN PATENT DOCUMENTS

CN 103413520 A 11/2013
CN 104252845 A 12/2015

* cited by examiner

PIXEL DRIVER CIRCUIT HAVING TWO PIXEL DRIVERS AND DISPLAY DEVICE THEREOF

CROSS-REFERENCE TO RELATED APPLICATIONS

This application is the U.S. national phase of PCT Application No. PCT/CN2016/075111 filed on Mar. 1, 2016, which claims priority to Chinese Patent Application No. 201520759201.X filed on Sep. 28, 2015, the disclosures of which are incorporated in their entirety by reference herein.

TECHNICAL FIELD

The present disclosure relates to the field of display technology, in particular to a pixel driver circuit, a pixel circuit, a display panel and a display device.

BACKGROUND

As compared with a liquid crystal display (LCD), an organic light-emitting diode (OLED) display device has attracted more and more attentions due to its advantages such as self-luminance, rapid response, high brightness, wide viewing angle, being rich in colors, and being thin and light.

Currently, as a mainstream development trend of the OLED display device, a gate voltage of a driving transistor may be changed, so as to control a source-to-drain current, thereby to change the brightness. In this regard, the driving transistor of the OLED display device may be in an on state for a long period of time, i.e., a positive or negative voltage may always be applied to the gate electrode of the driving transistor. However, a threshold voltage Vth and mobility of a conventional thin film transistor (TFT) made of different materials may change in the presence of direct current (DC) bias (i.e., the positive voltage may change in a trend opposite to the negative voltage), so such phenomena as change in the grayscale brightness, uneven grayscale (caused by the change in the characteristics of different TFTs) may easily occur after an OLED display panel operates for a certain period of time. It is impossible for a conventional pixel driver circuit to reduce the change in the grayscale brightness due to the change in the characteristics of the driving TFT after it works for a long period of time.

SUMMARY

A main object of the present disclosure is to provide a pixel driver circuit, a pixel circuit, a display panel and a display device, so as to reduce the change in the grayscale brightness due to the change in the characteristics of the driving TFT after it works for a long period of time in the pixel driving circuit.

In one aspect, the present disclosure provides in some embodiments a pixel driver circuit, including two pixel driving units having an identical structure. Each pixel driving unit includes a driving transistor and a driving control module. A gate electrode of the driving transistor is connected to the driving control module, a first electrode thereof is configured to receive a first power voltage, and a second electrode thereof is connected to the driving control module and a light-emitting element. The driving control module is connected to a data line, a gate line, and the gate electrode and the second electrode of the driving transistor, and configured to, under the control of a gate driving signal from the gate line, control a potential at the gate electrode of the driving transistor in accordance with a data voltage applied to the data line, so as to turn on or turn off the driving transistor.

Optionally, a first pixel driving unit of the pixel driver circuit is connected to a first data line, and a second pixel driving unit of the pixel driver circuit is connected to a second data line. Within a period for displaying one frame image, a first data voltage applied to the first data line has a value identical to, and a polarity opposite to, a value and a polarity of a second data voltage applied to the second data line. The first data voltage applied to the first data line within a period for displaying one frame image has a value identical to, and a polarity opposite to, a value and a polarity of the first data voltage applied to the first data line within a period for displaying another frame image next to the one frame image, and the second data voltage applied to the second data line within the period for displaying the one frame image has a value identical to, and a polarity opposite to, a value and a polarity of the second data voltage applied to the second data line within the period for displaying the other frame image next to the one frame image.

Optionally, the first pixel driving unit and the second pixel driving unit of the pixel driver circuit are connected to an identical gate line.

Optionally, the pixel driver circuit includes a first pixel driving unit and a second pixel driving unit having an identical structure. The first pixel driving unit includes a first driving transistor and a first driving control module, and the second pixel driving unit includes a second driving transistor and a second driving control module. The first driving control module includes a first storage capacitor, a first control transistor, a second control transistor and a first mirror transistor. A gate electrode of the first control transistor is connected to the gate line, a first electrode thereof is connected to a first end of the first storage capacitor, and a second electrode thereof is connected to a corresponding data line. A gate electrode of the second control transistor is connected to the gate line, a first electrode thereof is connected to a first electrode of the first mirror transistor, and a second electrode thereof is connected to the data line. A gate electrode of the first mirror transistor is connected to the first end of the first storage capacitor, and a second electrode thereof is connected to a second end of the first storage capacitor. The second driving control module includes a second storage capacitor, a third control transistor, a fourth control transistor and a second mirror transistor. A gate electrode of the third control transistor is connected to the gate line, a first electrode thereof is connected to a first end of the second storage capacitor, and a second electrode thereof is connected to a corresponding data line. A gate electrode of the fourth control transistor is connected to the gate line, a first electrode thereof is connected to a first electrode of the second mirror transistor, and a second electrode thereof is connected to the data line. A gate electrode of the second mirror transistor is connected to the first end of the second storage capacitor, and a second electrode thereof is connected to a second end of the second storage capacitor.

Optionally, the first mirror transistor has a process parameter identical to the first driving transistor, and the second mirror transistor has a process parameter identical to the second driving transistor.

Optionally, the first driving transistor, the first control transistor, the second control transistor and the first mirror transistor are n-type transistors, and the second driving transistor, the third control transistor, the fourth control transistor and the second mirror transistor are n-type transistors; or the first driving transistor, the first control transistor, the second control transistor and the first mirror transistor are p-type transistors, and the second driving transistor, the third control transistor, the fourth control transistor and the second mirror transistor are p-type transistors.

Optionally, a potential at the gate electrode of the first driving transistor of the first pixel driving unit within the period for displaying the one frame image has a value identical to, and a polarity opposite to, a value and a polarity of a potential at the gate electrode of the first driving transistor of the first pixel driving unit within the period for displaying the other frame image next to the one frame image, and a potential at the gate electrode of the second driving transistor of the second pixel driving unit within the period for displaying the one frame image has a value identical to, and a polarity opposite to, a value and a polarity of a potential at the gate electrode of the second driving transistor of the second pixel driving unit within the period for displaying the other frame image next to the one frame image.

In another aspect, the present disclosure provides in some embodiments a pixel circuit including a light-emitting element and the above-mentioned pixel driver circuit. The second electrodes of the driving transistors of the two pixel driving units in the pixel driver circuit are connected to the light-emitting element.

In yet another aspect, the present disclosure provides in some embodiments a display panel including the above-mentioned pixel circuit.

Optionally, a first pixel driving unit of a pixel driver circuit in the pixel circuit is connected to a first data line, and a second pixel driving unit of the pixel driver circuit is connected to a second data line. The display panel further includes a data driver circuit configured to apply a first data voltage to the first data line, and apply a second data voltage to the second data line. Within a period for displaying one frame image, the first data voltage applied to the first data line has a value identical to, and a polarity opposite to, a value and a polarity of the second data voltage applied to the second data line. The first data voltage applied to the first data line within a period for displaying one frame image has a value identical to, and a polarity opposite to, a value and a polarity of the first data voltage applied to the first data line within a period for displaying another frame image next to the one frame image, and the second data voltage applied to the second data line within the period for displaying the one frame image has a value identical to, and a polarity opposite to, a value and a polarity of the second data voltage applied to the second data line within the period for displaying the other frame image next to the one frame image.

In still yet another aspect, the present disclosure provides in some embodiments a display device including the above-mentioned display panel.

According to the pixel driver circuit, the pixel circuit, the display panel and the display device in the embodiments of the present disclosure, the two pixel driving units having an identical structure and operating alternately within a period for displaying one frame image and a period for displaying another frame image next to the one frame image may be adopted, and the polarities at the gate electrodes of the driving transistors of the two pixel driving units may be opposite to each other within the period for displaying one frame image and the period for displaying another frame image next to the one frame image. As a result, it is able to reduce the change in the grayscale brightness due to the change in the characteristics of the driving TFT after it works in a single direction for a long period of time.

DETAILED DESCRIPTION

Figure 1:
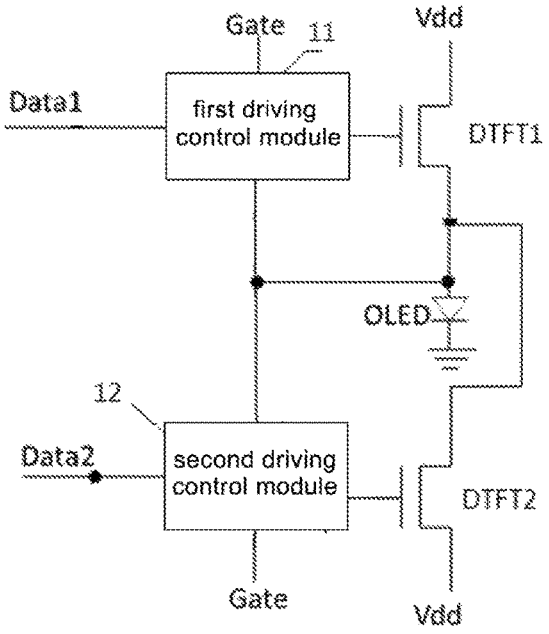
FIG. 1 is a schematic view showing a pixel driver circuit according to one embodiment of the present disclosure.

In order to make the objects, the technical solutions and the advantages of the present disclosure more apparent, the present disclosure will be described hereinafter in a clear and complete manner in conjunction with the drawings and embodiments. Obviously, the following embodiments merely relate to a part of, rather than all of, the embodiments of the present disclosure, and based on these embodiments, a person skilled in the art may, without any creative effort, obtain the other embodiments, which also fall within the scope of the present disclosure.

Unless otherwise defined, any technical or scientific term used herein shall have the common meaning understood by a person of ordinary skills. Such words as "first" and "second" used in the specification and claims are merely used to differentiate different components rather than to represent any order, number or importance. Similarly, such words as "one" or "a" are merely used to represent the existence of at least one member, rather than to limit the number thereof. Such words as "connect" or "connected to" may include electrical connection, direct or indirect, rather than to be limited to physical or mechanical connection. Such words as "on", "under", "left" and "right" are merely used to represent relative position relationship, and when an absolute position of the object is changed, the relative position relationship will be changed too.

The present disclosure provides in some embodiments a pixel driver circuit including two pixel driving units having an identical structure. Each pixel driving unit includes a driving transistor and a driving control module. A gate electrode of the driving transistor is connected to the driving control module, a first electrode thereof is configured to receive a first power voltage, and a second electrode thereof is connected to the driving control module and a light-emitting element. The driving control module is connected to a data line, a gate line, and the gate electrode and the second electrode of the driving transistor, and configured to, under the control of a gate driving signal from the gate line, control a potential at the gate electrode of the driving transistor in accordance with a data voltage applied to the data line, so as to turn on or turn off the driving transistor.

According to the pixel driver circuit in the embodiments of the present disclosure, the two pixel driving units having an identical structure and operating alternately within a period for displaying one frame image and a period for displaying another frame image next to the one frame image may be adopted, and the polarities at the gate electrodes of the driving transistors of the two pixel driving units may be opposite to each other within a period for displaying one frame image and a period for displaying another frame image next to the one frame image. As a result, it is able to reduce the change in the grayscale brightness due to the change in the characteristics of the driving transistor after it works in a single direction (i.e., the potentials at the gate electrode of the driving transistor always have an identical polarity) for a long period of time.

Optionally, a first pixel driving unit of the pixel driver circuit is connected to a first data line, and a second pixel driving unit of the pixel driver circuit is connected to a second data line. Within a period for displaying one frame image, a first data voltage applied to the first data line has a value identical to, and a polarity opposite to, a value and a polarity of a second data voltage applied to the second data line. Within a period for displaying one frame image and a period for displaying another frame image next to the one frame image, the first data voltages applied to the first data line have an identical value and opposite polarities, so as to enable the potentials at the gate electrode of the first driving transistor to have an identical value and opposite polarities within the period for displaying the frame image and the period for displaying the other frame image, thereby to reduce the change in the grayscale brightness due to the change in the characteristics of the first driving transistor after it works in a single direction for a long period of time. In addition, the second data voltages applied to the second data line have an identical value and opposite polarities within the period for displaying the frame image and the period for displaying the other frame image, so as to enable the potentials at the gate electrode of the second driving transistor to have an identical value and opposite polarities within the period for displaying the frame image and the period for displaying the other frame image, thereby to reduce the change in the grayscale brightness due to the change in the characteristics of the second driving transistor after it works in a single direction for a long period of time.

During the implementation, the first pixel driving unit and the second pixel driving unit of the pixel driver circuit may be connected to an identical gate line, and configured to, under the control of a gate driving signal from the gate line, charge a corresponding storage capacitor in accordance with a data voltage applied to a corresponding data line.

All the transistors adopted in the embodiments of the present disclosure may be TFTs, or field effect transistors (FETs), or any other elements having a similar characteristic. In the embodiments of the present disclosure, apart from the gate electrode, one of the other two electrodes of each transistor may be called as a source electrode, and other one may be called as a drain electrode. In addition, depending on its characteristic, each transistor may be an n-type or a p-type transistor. For the driver circuit in the embodiments of the present disclosure, all the transistors are n-type transistors. However, a person skilled in the art may understand that the p-type transistors may also be adopted under the teaching of the present disclosure, which also falls within the scope of the present disclosure.

As shown in FIG. 1, the pixel driver circuit includes a first pixel driving unit and a second pixel driving unit having a structure identical to the first pixel driving unit. The first pixel driving unit includes a first driving transistor DTFT1 and a first driving control module 11. A gate electrode of the first driving transistor DTFT1 is connected to the first driving control module 11, a first electrode thereof is configured to receive a high level Vdd, and a second electrode thereof is connected to the first driving control module 11 and an anode of an OLED. The first driving control module 11 is connected to a first data line Data1, a gate line Gate, and the gate electrode and the second electrode of the first driving transistor DTFT1, and configured to, under the control of a gate driving signal from the gate line Gate, control a potential at the gate electrode of the first driving transistor DTFT1 in accordance with a data voltage applied to the first data line Data1, so as to turn on or turn off the first driving transistor DTFT1.

The second pixel driving unit includes a second driving transistor DTFT2 and a second driving control module 12. A gate electrode of the second driving transistor DTFT2 is connected to the second driving control module 12, a first electrode thereof is configured to receive the high level Vdd, and a second electrode thereof is connected to the second driving control module 12 and the anode of the OLED. The second driving control module 12 is connected to a second data line Data2, the gate line Gate, and the gate electrode and the second electrode of the second driving transistor DTFT2, and configured to, under the control of the gate driving signal from the gate line Gate, control a potential at the gate electrode of the second driving transistor DTFT2 in accordance with a data voltage applied to the second data line Data2, so as to turn on or turn off the second driving transistor DTFT2. A cathode of the OLED is grounded.

Within a period for displaying one frame image, a first data voltage applied to the first data line Data1 has a value identical to, and a polarity opposite to, a second data voltage applied to the second data line Data2. Within a period for displaying one frame image and a period for displaying another frame image next to the one frame image, the first data voltages applied to the first data line Data1 have an identical value and opposite polarities, and the second data voltages applied to the second data line Data2 have an identical value and opposite polarities.

For the pixel driver circuit in FIG. 1, the first driving transistor DTFT1 and the second driving transistor DTFT2 are both n-type TFTs.

During the operation of the pixel driver circuit in FIG. 1, the first pixel driving unit and the second pixel driving unit operate alternately within a period for displaying one frame image and a period for displaying another frame image next to the one frame image. Within the period for displaying one frame image and the period for displaying the other frame image next to the one frame image, the potentials at the gate electrode of the first driving transistor have an identical value and opposite polarities, and the potentials at the gate electrode of the second driving transistor have an identical value and opposite polarities. As a result, it is able to reduce the change in the grayscale brightness due to the change in the characteristics of the first and second driving TFTs after they work in a single direction for a long period of time.

To be specific, the pixel driver circuit includes a first pixel driving unit and a second pixel driving unit having an identical structure. The first pixel driving unit includes a first driving transistor and a first driving control module, and the second pixel driving unit includes a second driving transistor and a second driving control module. The first driving control module includes a first storage capacitor, a first control transistor, a second control transistor and a first mirror transistor. A gate electrode of the first control transistor is connected to the gate line, a first electrode thereof is connected to a first end of the first storage capacitor, and a second electrode thereof is connected to a corresponding data line. A gate electrode of the second control transistor is connected to the gate line, a first electrode thereof is connected to a first electrode of the first mirror transistor, and a second electrode thereof is connected to the data line. A gate electrode of the first mirror transistor is connected to the first end of the first storage capacitor, and a second electrode thereof is connected to a second end of the first storage capacitor. The second driving control module includes a second storage capacitor, a third control transistor, a fourth control transistor and a second mirror transistor. A gate electrode of the third control transistor is connected to the gate line, a first electrode thereof is connected to a first end of the second storage capacitor, and a second electrode thereof is connected to a corresponding data line. A gate electrode of the fourth control transistor is connected to the gate line, a first electrode thereof is connected to a first electrode of the second mirror transistor, and a second electrode thereof is connected to the data line. A gate electrode of the second mirror transistor is connected to the first end of the second storage capacitor, and a second electrode thereof is connected to a second end of the second storage capacitor.

Through the above-mentioned structures of the first driving control module and the second driving control module, the first pixel driving unit and the second pixel unit may perform charging and light-emitting operations in a mirror manner. Hence, the first driving transistor and the second driving transistor may drive the light-emitting element at a current equal to a data current flowing through the data line.

Optionally, the first mirror transistor has a process parameter identical to the first driving transistor, and the second mirror transistor has a process parameter identical to the second driving transistor.

In an alternative embodiment of the present disclosure, in the case that the first mirror transistor has a process parameter that is in consistence with a parameter of the first driving transistor, and the second mirror transistor has a process parameter that is in consistence with a process parameter of the second driving transistor, a driving current for the light-emitting element at a light-emitting stage may be identical to the data current at a charging stage, so it is able to reduce, to some extent, the uneven grayscale caused by a difference in the threshold voltages Vth and mobility of different pixels in a current mirror compensation manner.

During the implementation, the first driving transistor, the first control transistor, the second control transistor and the first mirror transistor are n-type transistors, and the second driving transistor, the third control transistor, the fourth control transistor and the second mirror transistor are n-type transistors; or the first driving transistor, the first control transistor, the second control transistor and the first mirror transistor are p-type transistors, and the second driving transistor, the third control transistor, the fourth control transistor and the second mirror transistor are p-type transistors.

During the actual application, the first driving control module and the second driving control module may also be of any known circuit structures capable of inputting the data voltages to the first driving transistor and the second driving transistor, compensating for the threshold voltages and driving the light-emitting element to emit light, and thus they will not be particularly defined herein.

The pixel driver circuit will be described hereinafter in more details.

Figure 2:
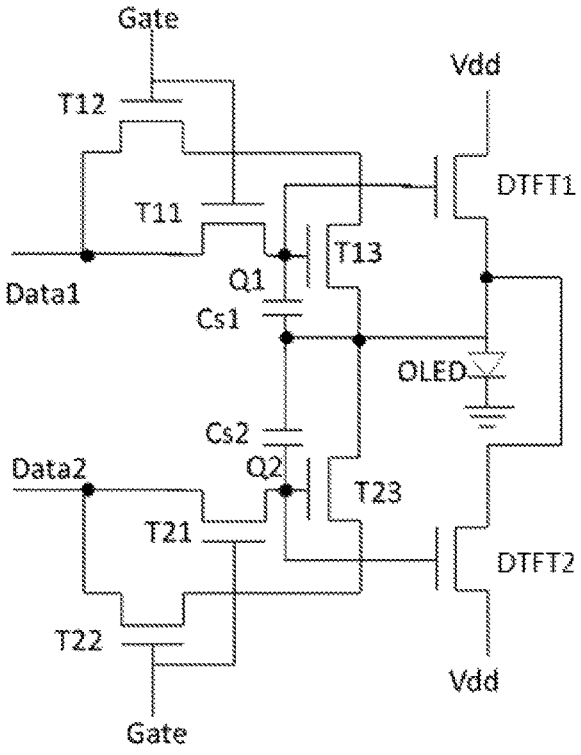
FIG. 2 is another schematic view showing the pixel driver circuit according to one embodiment of the present disclosure.

As shown in FIG. 2, in an alternative embodiment of the present disclosure, the pixel driver circuit includes a first pixel driving unit and a second pixel driving unit having a structure identical to the first pixel driving unit. The first pixel driving unit includes a first driving transistor DTFT1 and a first driving control module. The first driving control module includes a first storage capacitor Cs1, a first control transistor T11, a second control transistor T12 and a first mirror transistor T13. A gate electrode of the first driving transistor DTFT1 is connected to a first end of the first storage capacitor Cs1, a first electrode thereof is configured to receive the high level Vdd, and a second electrode thereof is connected to a second end of the first storage capacitor Cs1 and an anode of an OLED. A gate electrode of the first control transistor T11 is connected to the gate line Gate, a first electrode thereof is connected to the first end of the first storage capacitor Cs1, and a second electrode thereof is connected to a first data line Data1. A gate electrode of the second control transistor T12 is connected to the gate line Gate, a first electrode thereof is connected to a first electrode of the first mirror transistor T13, and a second electrode thereof is connected to the first data line Data1. A gate electrode of the first mirror transistor T13 is connected to the first end of the first storage capacitor Cs1, and a second electrode thereof is connected to the second end of the first storage capacitor Cs1.

The second pixel driving unit includes a second driving transistor DTFT2 and a second driving control module. The second driving control module includes a third control transistor T21, a fourth control transistor T22 and a second mirror transistor T23. A gate electrode of the second driving transistor DTFT2 is connected to a first end of the second storage capacitor Cs2, a first electrode thereof is configured to receive the high level Vdd, and a second electrode thereof is connected to a second end of the second storage capacitor Cs2 and the anode of the OLED. A gate electrode of the third control transistor T21 is connected to the gate line Gate, a first electrode thereof is connected to the first end of the second storage capacitor Cs2, and a second electrode thereof is connected to a second data line Data2. A gate electrode of the fourth control transistor T22 is connected to the gate line Gate, a first electrode thereof is connected to a first electrode of the second mirror transistor T23, and a second electrode thereof is connected to the second data line Data2. A gate electrode of the second mirror transistor T13 is connected to the first end of the second storage capacitor Cs2, and a second electrode thereof is connected to the second end of the second storage capacitor Cs2. A gate electrode of the first driving transistor DTFT1 is connected to a first control node Q1, a gate electrode of the second driving transistor DTFT2 is connected to a second control node Q2, and a cathode of the OLED is grounded.

For the pixel driver circuit in FIG. 2, all the transistors are n-type TFTs, so the first electrode may be a drain electrode and the second electrode may be a source electrode.

According to the pixel driver circuit in FIG. 2, the first pixel driving unit and the second pixel driving unit are configured to drive the OLED to emit light within a period for displaying one frame image and a period for displaying another frame image next to the one frame image in an alternate manner, so as to enable the first driving transistor DTFT1 and the second driving transistor DTFT2 to operate alternately, prevent the DC bias voltage from being always applied to the driving transistor, and reduce the change in the grayscale brightness due to the change in the characteristics of the driving transistor after it works for a long period of time. In addition, the first pixel driving unit and the second pixel driving unit of the pixel driver circuit in FIG. 2 perform the charging and light-emitting operations in a mirror manner, so the first driving transistor and the second driving transistor may drive the OLED at a current identical to the data current flowing through the data line. Further, the first mirror transistor T13 has process parameters that are in consistence with process parameters of the first driving transistor DTFT1, and the second mirror transistor T23 has process parameters that are in consistence with process parameters of the second driving transistor DTFT2, so the driving current for the OLED at the light-emitting stage is in consistence with the data current at the charging stage, and thereby it is able to reduce, to some extent, the uneven grayscale caused by a difference in the threshold voltages Vth and mobility of different pixels in a current mirror compensation manner.

Figure 3:
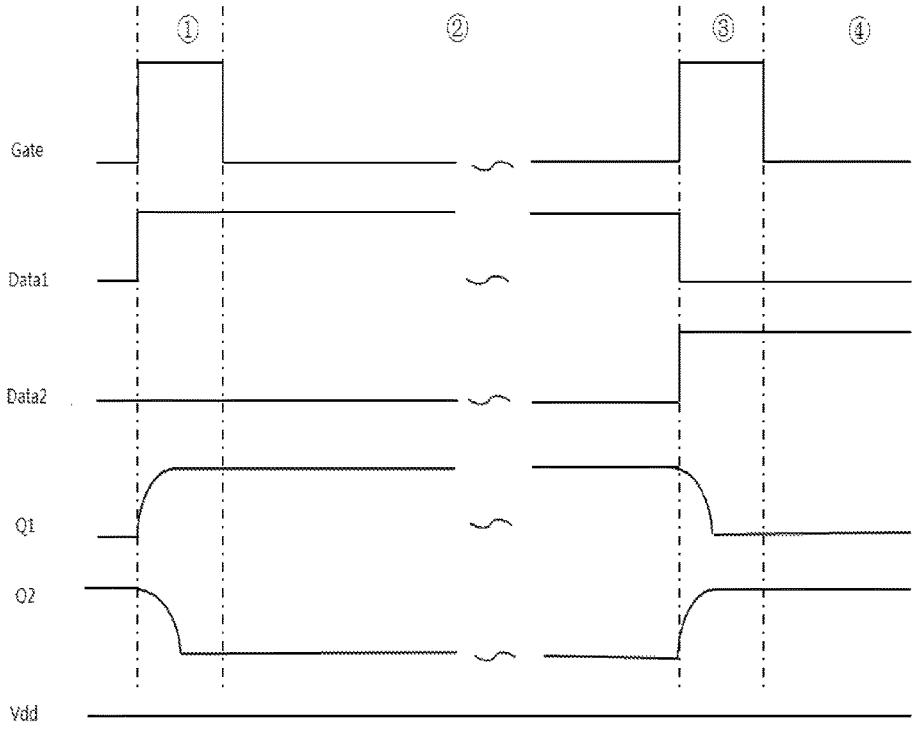
FIG. 3 is a sequence diagram of the pixel driver circuit in FIG. 2.

As shown in FIG. 3, during the operation of the pixel driver circuit in FIG. 2, at the charging stage within one frame (time period ①), the gate line Gate outputs a high level, so as to turn on the first control transistor T11, the second control transistor T12, the third control transistor T21 and the fourth control transistor T22. The first data line Data1 outputs a first constant data current $I_{data1}$ (a high level signal) corresponding to a grayscale. In an initial state, the first mirror transistor T13 is not in an on state. The first storage capacitor Cs1 is charged by $I_{data1}$ via the first control transistor T11, and a current flowing through the first control transistor T11 is $I_{T11}$. A voltage at the gate electrode (the first control node Q1) of the first mirror transistor T13 increases gradually, so as to turn on the first mirror transistor T13 gradually. At this time, a current IT13 flowing through the first mirror transistor T13 increases, $I_{T11}$ decreases, and $I_{T13}+I_{T11}=I_{data1}$. In the case that $I_{T13}=I_{data1}$ and $I_{T11}=0$, a voltage $V_{GS1}$ across the first storage capacitor Cs1 meets the following formula: $I_{data}1=k*(V_{GS1}-V_{th})^2$, where K is a current coefficient of the first driving transistor DTFT1, and Vth is a threshold voltage of the first driving transistor DTFT1. At this time, $I_{data1}$ flows through the first mirror transistor T13 via the second control transistor T12. The second data line Data2 outputs a second data current at a low level, so as to apply a low level signal to the second control node Q2 and turn off the second mirror transistor T23 and the second driving transistor DTFT2.

At the light-emitting stage within one frame (time period ②), the gate line Gate outputs a low level, so as to turn off the first control transistor T11, the second control transistor T12, the third control transistor T21 and the fourth control transistor T22. Q1 is maintained at a high level within the period for display one frame image due to the first storage capacitor Cs1, so the first mirror transistor T13 and the first driving transistor DTFT1 are maintained in the on state, and the driving current for the OLED is controlled by the first mirror transistor T13. The second control node Q2 is maintained at a low level within the period for display one frame image due to the second storage capacitor Cs2, so the second mirror transistor T23 and the second driving transistor DTFT2 are maintained in an off state.

Through a process design, the characteristic of the first driving transistor DTFT1 is in consistence with that of the first mirror transistor T13, i.e. the characteristic of the first driving transistor DTFT1 is approximately identical to that of the first mirror transistor T13. In addition, the gate voltage of the first mirror transistor T13 is equal to that of the first driving transistor DTFT1, so the data current $I_{data1}$ may be, as a mirror, a current for driving the OLED at the light-emitting stage. Vdd applies a voltage to the OLED for driving the OLED, and the current flowing through the OLED is always identical to $I_{data1}$ under the control of the first driving transistor DTFT1.

At the charging stage within a next frame (time period ③), the first data line Data1 outputs a low level signal, and the second data line Data2 outputs a constant, high-level signal $I_{data2}$, so as to turn on the first control transistor T11, the second control transistor T12, the third control transistor T21 and the fourth control transistor T22 under the control of the gate line Gate. The first control node Q1 is at a low level, and the second control node Q2 is at a high level, so the first mirror transistor T13 and the first driving transistor DTFT1 are in the off state, and the second mirror transistor T23 and the second driving transistor DTFT2 are in the on state. After the charging, a current $I_{T23}$ flowing through the second mirror transistor T23 is identical to $I_{data2}$ due to a voltage $V_{GS2}$ across the second storage capacitor Cs2.

At the light-emitting state within the next frame (time period ④), the second control node Q2 is maintained at a high level, so the second mirror transistor T23 and the second driving transistor DTFT2 are maintained in the on state. The driving current for the OLED is controlled by the second driving transistor DTFT2, and the current flowing through the OLED is identical to Idata2. The first control node Q1 is maintained at a low level, so the first mirror transistor T13 and the first driving transistor DTFT1 are maintained in the off state within the a period for display one frame image. Due to the first storage capacitor Cs1, it is able to reduce the influence of the high level in a previous frame on the characteristics of the first mirror transistor T13 and the first driving transistor DTFT1. In a period for displaying a next frame image after the above period, the gate driving signal from the gate line Gate is applied, and the states of the two TFT (i.e., the TFT in the first pixel driving unit and the TFT in the second pixel driving unit) may change. At this time, the first driving transistor DTFT1 is configured to drive the OLED, and the second driving transistor DTFT2 is in the off state, like that in the time period ①.

According to the pixel driver circuit in FIG. 2, the first driving transistor DTFT1 and the second driving transistor DTFT2 are configured to drive the OLED to emit light alternately within a period for displaying one frame image and a period for displaying another frame image next to the one frame image, and for the driving transistor that is not configured to drive the OLED to emit light within the period for displaying one frame image, the potential at the gate electrode thereof has an opposite polarity. As a result, it is able to prevent the DC bias voltage from being always applied to the driving transistor, and reduce the change in the grayscale brightness due to the change in the characteristic of the driving transistor after it works for a long period of time.

The present disclosure further provides in some embodiments a pixel circuit including a light-emitting element and the above-mentioned pixel driver circuit. The second electrodes of the driving transistors of the two pixel driving units in the pixel driver circuit are connected to the light-emitting element.

The present disclosure further provides in some embodiments a display panel including the above-mentioned pixel circuit. To be specific, a first pixel driving unit of a pixel driver circuit in the pixel circuit is connected to a first data line, and a second pixel driving unit of the pixel driver circuit is connected to a second data line. The display panel further includes a data driver circuit configured to apply a first data voltage to the first data line, and apply a second data voltage to the second data line. Within the period for displaying one frame image, the first data voltage applied to the first data line has a value identical to, and a polarity opposite to, the second data voltage applied to the second data line. Within a period for displaying one frame image and a period for displaying another frame image next to the one frame image, the first data voltages applied to the first data line have an identical value and opposite polarities, and the second data voltages applied to the second data line have an identical value and opposite polarities.

The present disclosure further includes a display device including the above-mentioned display panel.

The above are merely the preferred embodiments of the present disclosure. Obviously, a person skilled in the art may make further modifications and improvements without departing from the spirit of the present disclosure, and these modifications and improvements shall also fall within the scope of the present disclosure

What is claimed is:

1. A pixel driver circuit, comprising:

a first pixel driving unit and a second driving pixel unit having an identical structure, each of the first pixel driving unit and the second pixel driving unit comprising a driving transistor and a driving control module;

wherein a gate electrode of the driving transistor is connected to the driving control module, a first electrode of the driving transistor is configured to receive a first power voltage, a second electrode of the driving transistor is connected directly to the driving control module and a light-emitting element, and the light-emitting element is further connected directly to the driving control module; and the driving control module is connected to a data line, a gate line, and the gate electrode and the second electrode of the driving transistor, and configured to, under the control of a gate driving signal from the gate line, control a potential at the gate electrode of the driving transistor in accordance with a data voltage applied to the data line, to control the driving transistor to be turned on or turned off, wherein the driving control module of the first pixel driving unit comprises a first storage capacitor, a first control transistor, a second control transistor and a first mirror transistor;

a gate electrode of the first control transistor is connected directly to the gate line, a first electrode of the first control transistor is connected directly to a first end of the first storage capacitor, and a second electrode of the first control transistor is connected directly to a corresponding data line;

a gate electrode of the second control transistor is connected directly to the gate line, a first electrode of the second control transistor is connected directly to a first electrode of the first mirror transistor, and a second electrode of the second control transistor is connected directly to the data line;

a gate electrode of the first mirror transistor is connected directly to the first end of the first storage capacitor, and a second electrode of the first mirror transistor is connected directly to a second end of the first storage capacitor;

the driving control module of the second pixel driving unit comprises a second storage capacitor, a third control transistor, a fourth control transistor and a second mirror transistor;

a gate electrode of the third control transistor is connected directly to the gate line, a first electrode of the third control transistor is connected directly to a first end of the second storage capacitor, and a second electrode of the third control transistor is connected directly to a corresponding data line;

a gate electrode of the fourth control transistor is connected directly to the gate line, a first electrode of the fourth control transistor is connected directly to a first electrode of the second mirror transistor, and a second electrode of the fourth control transistor is connected directly to the data line; and a gate electrode of the second mirror transistor is connected directly to the first end of the second storage capacitor, and a second electrode of the second mirror transistor is connected directly to a second end of the second storage capacitor.

2. The pixel driver circuit according to claim 1, wherein the first pixel driving unit is connected to a first data line, and the second pixel driving unit is connected to a second data line;

within a period for displaying one frame image, a first data voltage applied to the first data line has a value identical to, and a polarity opposite to, a value and a polarity of a second data voltage applied to the second data line; and the first data voltage applied to the first data line within a period for displaying one frame image has a value identical to, and a polarity opposite to, a value and a polarity of the first data voltage applied to the first data line within a period for displaying another frame image next to the one frame image, and the second data voltage applied to the second data line within the period for displaying the one frame image has a value identical to, and a polarity opposite to, a value and a polarity of the second data voltage applied to the second data line within the period for displaying the other frame image next to the one frame image.

3. The pixel driver circuit according to claim 2, wherein the first pixel driving unit and the second pixel driving unit of the pixel driver circuit are connected to an identical gate line.

4. The pixel driver circuit according to claim 3, wherein the first mirror transistor has process parameters identical to process parameters of the driving transistor of the first pixel driving unit, and the second mirror transistor has process parameters identical to process parameters of the driving transistor of the second pixel driving unit.

5. The pixel driver circuit according to claim 4, wherein the driving transistor of the first pixel driving unit, the first control transistor, the second control transistor and the first mirror transistor are n-type transistors, and the driving transistor of the second pixel driving unit, the third control transistor, the fourth control transistor and the second mirror transistor are n-type transistors; or the driving transistor of the first pixel driving unit, the first control transistor, the second control transistor and the first mirror transistor are p-type transistors, and the driving transistor of the second pixel driving unit, the third control transistor, the fourth control transistor and the second mirror transistor are p-type transistors.

6. A pixel circuit, comprising a light-emitting element and the pixel driver circuit according to claim 3, wherein the second electrodes of the driving transistors of the first and second pixel driving units in the pixel driver circuit are connected to the light-emitting element.

7. The pixel driver circuit according to claim 2, wherein a potential at the gate electrode of the driving transistor of the first pixel driving unit within the period for displaying the one frame image has a value identical to, and a polarity opposite to, a value and a polarity of a potential at the gate electrode of the driving transistor of the first pixel driving unit within the period for displaying the other frame image next to the one frame image; and a potential at the gate electrode of the driving transistor of the second pixel driving unit within the period for displaying the one frame image has a value identical to, and a polarity opposite to, a value and a polarity of a potential at the gate electrode of the driving transistor of the second pixel driving unit within the period for displaying the other frame image next to the one frame image.

8. The pixel driver circuit according to claim 2, wherein the first mirror transistor has process parameters identical to process parameters of the driving transistor of the first pixel driving unit, and the second mirror transistor has process parameters identical to process parameters of the driving transistor of the second pixel driving unit.

9. The pixel driver circuit according to claim 8, wherein the driving transistor of the first pixel driving unit, the first control transistor, the second control transistor and the first mirror transistor are n-type transistors, and the driving transistor of the second pixel driving unit, the third control transistor, the fourth control transistor and the second mirror transistor are n-type transistors; or the driving transistor of the first pixel driving unit, the first control transistor, the second control transistor and the first mirror transistor are p-type transistors, and the driving transistor of the second pixel driving unit, the third control transistor, the fourth control transistor and the second mirror transistor are p-type transistors.

10. A pixel circuit, comprising a light-emitting element and the pixel driver circuit according to claim 2, wherein the second electrodes of the driving transistors of the first and second pixel driving units in the pixel driver circuit are connected to the light-emitting element.

11. The pixel driver circuit according to claim 1, wherein the first mirror transistor has process parameters identical to process parameters of the driving transistor of the first pixel driving unit, and the second mirror transistor has process parameters identical to process parameters of the driving transistor of the second pixel driving unit.

12. The pixel driver circuit according to claim 11, wherein the driving transistor of the first pixel driving unit, the first control transistor, the second control transistor and the first mirror transistor are n-type transistors, and the driving transistor of the second pixel driving unit, the third control transistor, the fourth control transistor and the second mirror transistor are n-type transistors; or the driving transistor of the first pixel driving unit, the first control transistor, the second control transistor and the first mirror transistor are p-type transistors, and the driving transistor of the second pixel driving unit, the third control transistor, the fourth control transistor and the second mirror transistor are p-type transistors.

13. A pixel circuit, comprising a light-emitting element and the pixel driver circuit according to claim 11, wherein the second electrodes of the driving transistors of the first and second pixel driving units in the pixel driver circuit are connected to the light-emitting element.

14. A pixel circuit, comprising a light-emitting element and the pixel driver circuit according to claim 1, wherein the second electrodes of the driving transistors of the first and second pixel driving units in the pixel driver circuit are connected to the light-emitting element.

15. A display panel comprising the pixel circuit according to claim 14.

16. The display panel according to claim 15, wherein the first pixel driving unit of the pixel driver circuit in the pixel circuit is connected to a first data line, and the second pixel driving unit of the pixel driver circuit is connected to a second data line;

the display panel further comprises: a data driver circuit configured to apply a first data voltage to the first data line, and apply a second data voltage to the second data line;

within a period for displaying one frame image, the first data voltage applied to the first data line has a value identical to, and a polarity opposite to, a value and a polarity of the second data voltage applied to the second data line; and the first data voltage applied to the first data line within a period for displaying one frame image has a value identical to, and a polarity opposite to, a value and a polarity of the first data voltage applied to the first data line within a period for displaying another frame image next to the one frame image, and the second data voltage applied to the second data line within the period for displaying the one frame image has a value identical to, and a polarity opposite to, a value and a polarity of the second data voltage applied to the second data line within the period for displaying the other frame image next to the one frame image.

17. A display device, comprising the display panel according to claim 15.

* * * * *